US008109455B2

(12) United States Patent
Allen

(10) Patent No.: US 8,109,455 B2
(45) Date of Patent: Feb. 7, 2012

(54) DELIVERY OF AGENTS TO THE CUTTING MECHANISM OF PAPER SHREDDERS

(75) Inventor: Mark S. Allen, Orem, UT (US)

(73) Assignee: Buttercup Legacy, LLC, Orem, UT (US)

( * ) Notice: Subject to any disclaimer, the term of this patent is extended or adjusted under 35 U.S.C. 154(b) by 1237 days.

(21) Appl. No.: 11/686,237

(22) Filed: Mar. 14, 2007

(65) Prior Publication Data

US 2007/0164138 A1 Jul. 19, 2007

Related U.S. Application Data

(63) Continuation-in-part of application No. 11/563,616, filed on Nov. 27, 2006, now Pat. No. 7,902,129, which is a continuation-in-part of application No. 10/925,470, filed on Aug. 25, 2004, now Pat. No. 7,166,561.

(60) Provisional application No. 60/514,154, filed on Oct. 23, 2003, provisional application No. 60/759,733, filed on Jan. 18, 2006.

(51) Int. Cl.
*B22C 18/22* (2006.01)
*B22C 18/16* (2006.01)

(52) U.S. Cl. ..... 241/38; 241/15; 508/100; 184/109

(58) Field of Classification Search ..... 508/100; 241/15, 38; 184/109
See application file for complete search history.

(56) References Cited

U.S. PATENT DOCUMENTS 2,350,366 A 6/1944 Mitchell
3,258,210 A 6/1966 Panning
3,333,752 A 8/1967 Vincens
3,472,675 A 10/1969 Gordon et al.
3,911,579 A 10/1975 Lane et al.
4,014,351 A * 3/1977 Pittet et al. ..... 131/276
4,506,682 A * 3/1985 Muller ..... 131/297
4,611,361 A 9/1986 Shinkai
(Continued)

FOREIGN PATENT DOCUMENTS

DE 3426979 1/1986
(Continued)

OTHER PUBLICATIONS

Office Action dated Jul. 7, 2010 cited in U.S. Appl. No. 11/563,616.
(Continued)

*Primary Examiner* — Jim Goloboy
(74) *Attorney, Agent, or Firm* — Workman Nydegger

(57) ABSTRACT

Devices for application of agents to the cutting mechanism of paper shredders are disclosed. Maintenance and lubrication can be performed by applying lubrication agents to the cutting mechanism of a paper shredder without requiring disassembly of the paper shredder. The agents can also include scented agents and decomposing agents or a combination thereof. Lubrication sheets are disclosed for applying agents to the cutting mechanism of paper shredders. A holder is disclosed for retaining lubrication sheets within proximity of a paper shredder. Paper shredders are also disclosed having various means for identifying when lubrication is needed and/or when the cutting mechanism of the paper shredder is lubricated by a lubrication sheet. Paper shredders having a reservoir of lubricant for delivery to the cutting mechanism of the paper shredder are also disclosed. Such reservoirs may be removable. Cap designs allowing use of a removable reservoir with the paper shredders are also disclosed.

23 Claims, 11 Drawing Sheets

U.S. PATENT DOCUMENTS

| | | | | |
|---|---|---|---|---|
| 4,657,192 | A * | 4/1987 | Browning | 241/224 |
| 4,821,967 | A * | 4/1989 | Moriyama | 241/37.5 |
| 4,891,265 | A | 1/1990 | Samagalsky | |
| 5,009,410 | A * | 4/1991 | Fujii et al. | 271/127 |
| 5,105,836 | A * | 4/1992 | Gentry et al. | 131/359 |
| 5,186,398 | A | 2/1993 | Vigneaux, Jr. | |
| 5,188,301 | A | 2/1993 | Hasegawa | |
| 5,250,353 | A | 10/1993 | Bartholomew et al. | |
| 5,494,229 | A * | 2/1996 | Rokos et al. | 241/15 |
| 5,681,148 | A * | 10/1997 | Friedman et al. | 417/36 |
| 5,698,305 | A | 12/1997 | Suzuki et al. | |
| 6,079,645 | A | 6/2000 | Henreckson et al. | |
| 6,123,221 | A | 9/2000 | Simpson | |
| 6,212,700 | B1 * | 4/2001 | Giesler et al. | 4/420 |
| 6,416,624 | B1 | 7/2002 | Nielsen et al. | |
| 6,978,954 | B2 * | 12/2005 | Kroger et al. | 241/36 |
| 6,988,590 | B1 * | 1/2006 | Knight | 184/27.1 |
| 7,166,561 | B2 | 1/2007 | Allen | |
| 7,631,822 | B2 | 12/2009 | Matlin et al. | |
| 7,631,823 | B2 | 12/2009 | Matlin et al. | |
| 7,631,824 | B2 | 12/2009 | Matlin et al. | |
| 7,635,102 | B2 | 12/2009 | Matlin et al. | |
| 7,712,158 | B2 * | 5/2010 | Mehta | 4/319 |
| 7,712,689 | B2 | 5/2010 | Matlin et al. | |
| 7,798,435 | B2 | 9/2010 | Matlin | |
| 2005/0218250 | A1 | 10/2005 | Matlin et al. | |
| 2006/0049291 | A1 | 3/2006 | Rajewski | |
| 2006/0054724 | A1 | 3/2006 | Matlin et al. | |
| 2006/0054725 | A1 | 3/2006 | Matlin | |
| 2006/0138261 | A1 | 6/2006 | Ho | |
| 2006/0157601 | A1 | 7/2006 | Maitlin et al. | |
| 2006/0169619 | A1 | 8/2006 | Wang | |
| 2006/0208117 | A1 | 9/2006 | Castronovo | |
| 2006/0219827 | A1 | 10/2006 | Matlin et al. | |
| 2006/0243631 | A1 | 11/2006 | Duke | |
| 2007/0007373 | A1 | 1/2007 | Maitlin et al. | |
| 2007/0075170 | A1 | 4/2007 | Kim | |
| 2007/0080252 | A1 | 4/2007 | Pierce et al. | |
| 2007/0221767 | A1 | 9/2007 | Maitlin | |

FOREIGN PATENT DOCUMENTS

| | | |
|---|---|---|
| DE | G87022079 | 7/1987 |
| DE | G87022079 U1 * | 7/1987 |
| DE | 29709492 | 8/1997 |
| GB | 1502067 | 2/1978 |
| GB | 2187238 | 1/1986 |
| GB | 2187238 | 9/1987 |
| JP | 57-76734 | 8/1982 |
| JP | 1299646 | 12/1989 |
| JP | 8001023 | 1/1996 |
| WO | WO 00/67924 | 5/2000 |
| WO | WO2006031324 | 3/2006 |
| WO | WO 2006/036370 | 4/2006 |
| WO | WO2006074122 | 7/2006 |

OTHER PUBLICATIONS

BPAI Decision dated Aug. 19, 2010.

Lewis, Richard J., Sr. (2002). Hawley's Condensed Chemical Dictionary (14th Edition). John Wiley & Sons.

Machine translation from http:babelfish.altavista.com for DE3426979, Jan. 30, 1986.

MBM Corporation/IDEAL.MBM Corporation "Destroyit" Shredders 2400 Series model specification sheet—Sheet Capacity Specification, http://www.mbmcorp.com/pdfs/br_0271.pdf, 2006.

Staples Product Support Center, Staples Brand Product Support, Staples 20-Sheet Cross Cut Shredder, downloaded Oct. 10, 2007, available at http://product-support-staples.com.

Amendment dated Oct. 31, 2006 cited in U.S. Appl. No. 10/925,470.

Examiner Interview Summary dated Oct. 19, 2006 cited U.S. Appl. No. 10/925,470.

Examiner Interview Summary dated Nov. 29, 2005 cited U.S. Appl. No. 10/925,470.

Office Action dated Aug. 7, 2006 cited in U.S. Appl. No. 10/925,470.

Reply Brief filed Apr. 17, 2009 cited in U.S. Appl. No. 90/008,820.

Examiner's Answer to Appeal Brief dated Apr. 2, 2009 cited in U.S. Appl. No. 90/008,820.

Supplemental Appeal Brief filed Nov. 10, 2008 cited in U.S. Appl. No. 90/008,820.

Reexam Preceeding Advisory Action dated Aug. 15, 2008 cited in U.S. Appl. No. 90/008,820.

Reexam Response to Final Office Action filed Aug. 13, 2008 cited in U.S. Appl. No. 90/008,820.

Reexam Preceeding Advisory Action dated Jul. 30, 2008 cited in U.S. Appl. No. 90/008,820.

Reexam Response to Final Office Action filed Jul. 23, 2008 cited in U.S. Appl. No. 90/008,820.

Examiner's Interview Summary dated Jul. 2, 2008 cited in U.S. Appl. No. 90/008,820.

Reexam Final Office Action dated Jul. 2, 2008 cited in U.S. Appl. No. 90/008,820.

Reexam Response to Final Office Action filed Jun. 20, 2008 cited in U.S. Appl. No. 90/008,820.

Reexam Non-Final Office Action dated May 22, 2008 cited in U.S. Appl. No. 90/008,820.

Reexam Determination Ordered dated Oct. 3, 2007 cited in U.S. Appl. No. 90/008,820.

Request for Ex Parte Reexam dated Aug. 27, 2007 cited in U.S. Appl. No. 90/008,820.

U.S. Appl. No. 11/177,480 to Tai Matlin entitled "*Shredder Throat Safety System*," filed Jul. 11, 2005.

U.S. Appl. No. 11/385,864 to Tai Matlin entitled "*Shredder With Oiling Mechanism*" filed Mar. 22, 2006.

Lessons Learned Database, *Aerosol Lubricants Can Flash when Sprayed on Energized Shredders*, retrieved from http://www.eh.doe.gov/ll/lldb/detail.CFM?Lessons_IdentifierIntern=LANL-MATSC-CMPLX-2004-0002 on Oct. 24, 2006 (dated Jan. 28, 2004).

Safety Digest de Securite, *Valuable Lessons at Low Cost*, retrieved from http://www.vcds.forces.gc.ca/dsafeg/pubs/digest/6-03/art06_e.asp on Dec. 27, 2006 (Dated Jun. 2003).

*Shredder Maintenance*. Secure Shredders. Printed Feb. 24, 2006, upon information and belief, available at least as early as Aug. 24, 2000, http://www.secureshredders.com/ss/partssupplies/oil/index.html#oil/.

Quill Catalog, p. 1172, upon information and belief, available at least as early as Sep. 2000.

Ideal Operating Instructions. MBM Corporation/IDEAL.MBM Corporation [retrieved on Feb. 22, 2005]. Retrieved from Internet: http://www.mbmcorp.com/pdfs/zo_0106.pdf.

MBM Corporation/IDEAL.MBM Corporation. "*Destroyit*" Shredders 2400 series model Specification Sheet—Sheet Capacity Specification, 2006 http://www.mbmcorp.com/pdfs/br_0271.pdf.

* cited by examiner

DELIVERY OF AGENTS TO THE CUTTING MECHANISM OF PAPER SHREDDERS

CROSS-REFERENCE TO RELATED APPLICATIONS

This application is a continuation-in-part of U.S. patent application Ser. No. 11/563,616 filed Nov. 27, 2006 now U.S. Pat. No. 7,902,129. U.S. patent application Ser. No. 11/563,616 is a continuation-in-part of U.S. patent application Ser. No. 10/925,470 filed Aug. 25, 2004 now U.S. Pat. No. 7,166,561 which claims the benefit of U.S. Provisional Patent Application Ser. No. 60/514,154 filed Oct. 23, 2003. U.S. patent application Ser. No. 11/563,616 also claims the benefit of U.S. Provisional Patent Application 60/759,733 filed Jan. 18, 2006. The contents of each of these patent applications are hereby incorporated by reference herein.

BACKGROUND OF THE INVENTION

1. The Field of the Invention

The present invention relates to the maintenance of paper shredders. More specifically, the present invention relates to delivery of lubricants and other agents to cutting mechanisms of paper shredders.

2. The Relevant Technology

In today's corporate world it is becoming increasingly popular to dispose of important business documents through paper shredding. The paper shredders come in various shapes and sizes, but they all have a similar goal; to shred important documents to protect privacy and business transactions and protect corporate know how.

To effectively shred documents, paper shredders require periodic maintenance and lubrication. Shredders are typically taken apart and manually oiled via a spray solution or liquid dispenser, which is problematic in several ways. Many owners and users of paper shredders fail to properly maintain and lubricate their machines because of the difficulty and inconvenience involved. This can lead to failure of the shredder and the expense of purchasing a new shredder. Those who do maintain their shredders often must hire service personnel to complete this task.

When owners or users of paper shredders personally dissemble and lubricate their shredders, they can be exposed to messy and potentially hazardous oils and inhalation of sprays. Moreover, inconsistent lubrication by consumers has resulted in injury as a result of lubricant combustion. Thus, while paper shredders are common in many homes and businesses, there is a need to improve the manner in which the paper shredders are maintained and serviced. There is also a need to improve the manner in which documents are destroyed by paper shredders so as to increase protection of information from unauthorized access.

BRIEF SUMMARY OF THE INVENTION

Several embodiments disclosed herein relate to the maintenance of shredders, such as, but not limited to, paper shredders.

A holder for retaining one or more lubrication sheets within a proximity of a paper shredding device. The holder includes a sleeve sized and configured to receive the one or more lubrication sheets within the sleeve and retain the one or more lubrication sheets within a proximity of the paper shredding device. In some embodiments, the sleeve is integral with the paper shredder, and in other embodiments the sleeve includes means for attaching the sleeve to the paper shredder.

A cap is disclosed. The cap is configured to couple an agent contained within a removable reservoir to a paper shredding device. The cap includes a peripheral wall and an open proximal end configured to attach to an open end of the removable reservoir. A distal end of the cap is configured to releasably attach to an inlet conduit of a paper shredding device. The inlet conduit of the paper shredder is configured to receive the agent from the removable reservoir for application of the agent to a cutting mechanism of the paper shredding device.

A paper shredder is disclosed. The paper shredder includes a shredding mechanism with at least one blade capable of shredding paper. The paper shredder further includes a feeding mechanism configure to feed paper to the shredding mechanism. The paper shredder further includes a delivery mechanism configured to deliver an agent to the paper prior to the paper being shredded by the shredding mechanism and a reservoir in communication with the delivery mechanism. The delivery mechanism selectively draws the agent from the reservoir for delivering the agent to the paper shredded by the shredding mechanism.

These and other objects and features of the present invention will become more fully apparent from the following description and appended claims, or may be learned by practicing the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

Figure 1:
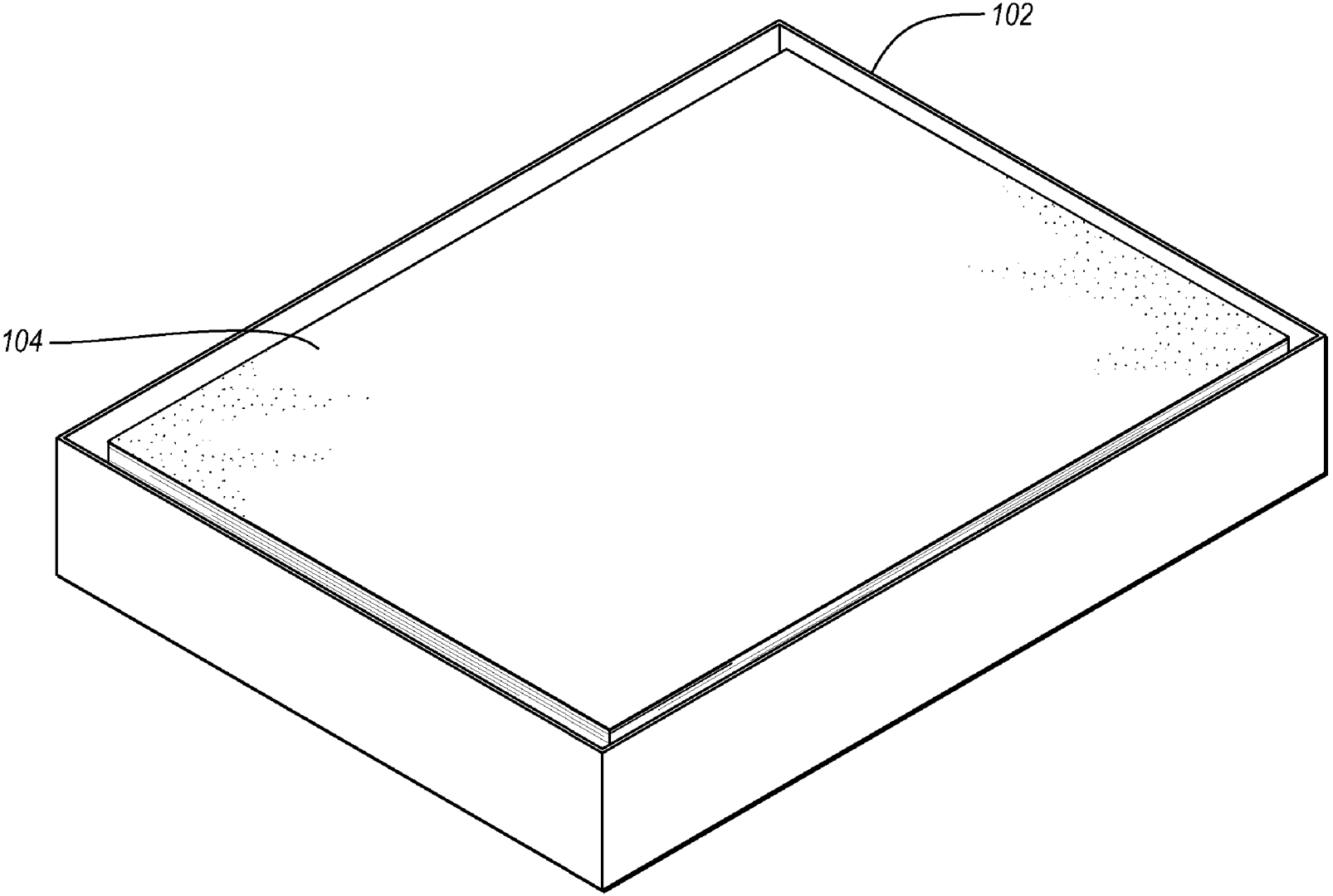
FIG. 1 illustrates a group of corrugated tissue papers that are impregnated with oil for lubricating a paper shredder.

Several embodiments disclosed herein relate to the maintenance of paper shredders using a substrate that is treated or carries an agent and can be fed through the shredding mechanism of a paper shredder to deliver the agent to the shredding elements of the paper shredder. The devices that are used in this manner are referred to herein as "sheets," and "lubrication sheets" interchangeably, and various examples thereof are disclosed in this document. As such, use of the word "lubrication" is not limited to lubricants, but can further include, or consist of, decomposition agents, scented agents, and/or any other agents for delivery to a shredding mechanism of a paper shredder. The decomposition agents may act as cleaning agents and may act in conjunction with the lubricant or independent of the lubricant. Similarly, the scented agents may be applied in conjunction with decomposition agents, lubrication agents, or any other agents.

According to some embodiments, the use of lubrication sheets that deliver lubricants to shredding elements of paper shredders greatly simplifies the process of maintaining and lubricating paper shredders. Rather than requiring disassembly of the paper shredder, maintenance and lubrication can be performed by passing a lubrication sheet through the shredding mechanism. This process requires no specialized mechanical or maintenance skill other than knowledge of how to operate a paper shredder. Moreover, lubrication sheets are much cleaner than the lubricants or sprays that have been conventionally used after a paper shredder has been disassembled.

While the following discussion of several embodiments will be directed generally to the use of substrates for carrying and releasing a lubricant to the blades of a paper shredder, the principles of the invention can also be applied to the delivery of other substances into a paper shredder or other type of shredder. As such, the term "lubrication sheet" refers to any type of structure or sheet-type material that can pass through a shredder and aid with delivery of an agent to the shredding elements of a paper shredder. Thus, the lubrication sheets can facilitate delivery of lubricating agents, scented agents, and/or decomposition agents, as well as any combination and relative amounts of other lubricating, cleaning, scented, and maintenance agents, to the shredding elements of a shredder.

For example, several embodiments relate to delivery sheets for delivery of one or more decomposition agents to the shredding elements of a paper shredder. According to these embodiments, a decomposition agent may aid in and help facilitate decomposition of debris, such as paper, in the shredding elements thereby cleaning the shredding elements. Moreover, a decomposition element can facilitate decomposition of ink. Decomposition of ink can relate to improved destruction of information recorded on shredded material, such as confidential documents. As such, a decomposition agent can create an additional obstacle to reconstruction of a shredded document and subsequent discovery of information recorded on the shredded document. Therefore, the ink eating microbes may help provide an additional level of security and protect sensitive data from identity theft.

Several of the embodiments disclosed herein further include means for retaining a measured amount of lubricant, or other agent, in an even distribution across a length and/or width of the lubrication sheet. Thus, the amount and type of agents delivered can be manufacturer controlled and selected. For example, referring to FIGS. 1-7B, various embodiments of means for retaining an even distribution of a measured amount of lubricant are illustrated. Such means can include structures such as bubbles, tubes, and absorptive substrates as well as other lubrication substrates having properties capable of retaining the even distribution of a measured amount of lubricant. In some embodiments, the lubrication sheets include a composite of different agents which may or may not be separated into different compartments (e.g. tubes, bubbles, portions, layers) of the lubrication sheets. As such, manufacturers of the lubrication sheets may have increased control over the type, order, and amount of agent(s) applied to the cutting mechanisms, as well as the rate at which the agent(s) is applied to the cutting mechanisms.

Any portion of the sheets may carry imagery or text. For example, the substrates or the shells may include advertising or instructions. Where the shell carries advertising or instructions, a shell layer may be substantially translucent to allow the advertising or instructions on the substrate to be seen through the shell layer.

FIGS. 1-7B illustrate various embodiments of the lubrication sheets and the methods for maintaining and lubricating paper shredders using the lubrication sheets. The substrates can come in a variety of form factors including corrugated paper, cardboard, waxboard and other materials capable of carrying a lubricant on its surface or capable of being saturated with a measured amount of lubricant. The substrates may or may not be encased by a shell or may be represented solely by a shell.

Figure 2:
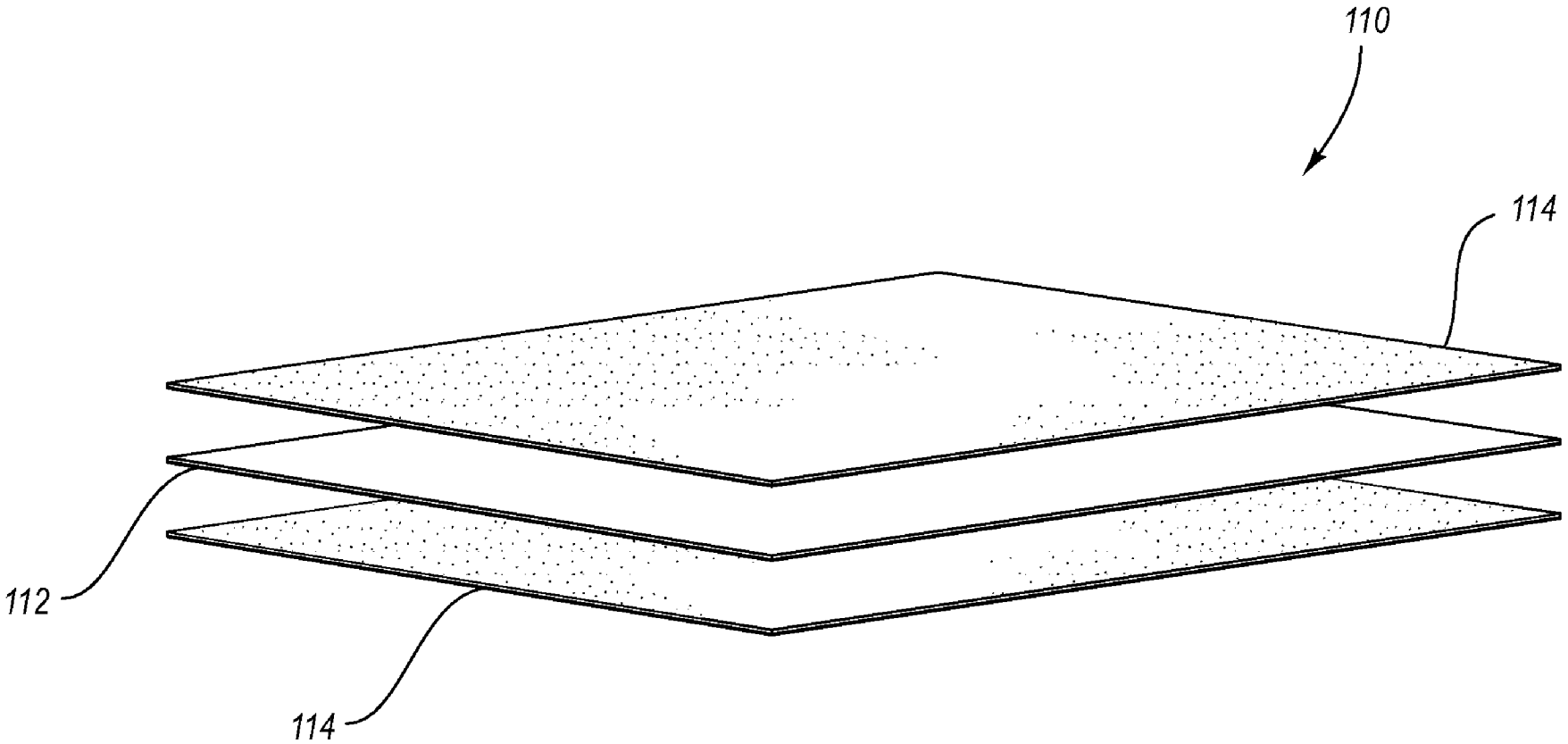
FIG. 2 illustrates a sealed plastic envelope that contains an oil-impregnated layer for lubricating a paper shredder.

For example, FIGS. 1 and 2 illustrate an embodiment of a lubrication sheet that includes a shell that encases a substrate that is treated with oil or another lubricant. The shell can be formed from cellophane or from a polymeric, or plastic, material, in which case, the shell is substantially non-penetrable and seals the encased substrate and lubricant, while protecting the user from exposure to any oily substance or lubricant.

The shell of FIGS. 1 and 2 and the other shells disclosed herein include one or more shell layers positioned, respectively, on one or either side of the lubrication sheet. The shell layers can be impermeable to the lubricant or, in other embodiments, can be formed from paper or another material that is not necessarily impermeable to the lubricant. For example, in embodiments, such as those of FIGS. 3-6, in which the lubricant is encased by the structure of the lubricant sheet, the user can be protected from exposure to the lubricant without requiring an impermeable shell layer.

In some embodiments, the shell layers can provide mechanical stiffness and/or rigidity to the lubrication sheets, which can be useful in facilitating the act of passing the lubrication sheet through the shredding mechanism. The lubrication substrate can also provide a mechanical stiffness and/or rigidity to the lubrication sheets in any of the embodiments disclosed herein. Thus, any portion of any structure disclosed herein, such as any portion of the shell layer(s) and/or lubrication substrate(s), can provide mechanical stiffness and/or rigidity. Moreover, additional structures can be implemented to provide stiffness and/or rigidity to the lubrication sheets. Such stiffness and/or rigidity attributes can improve cleaning, lubrication, and/or removal of debris from cutting elements of paper shredders. However, the substrate and shell layers, or other portions of the embodiments, may or may not be mechanically stiff or rigid in some embodiments. For example, in several embodiments implementing scented agents, the sheet may or may not be stiff or rigid or even carry other agents than the scented agent, such as lubrication or decomposition agents. Moreover, the shell layers and substrate may be relatively stiff in one direction across the lubrication sheet but less stiff in a second direction across the lubrication sheet.

The shell layers and/or the substrates can also be substantially brittle and have a shear strength and stiffness characteristic that promotes rupture instead of stretching, thinning, and clogging of the cutting mechanism. For example, at least a portion of a shell layer and/or a substrate in any of the embodiments disclosed herein can be substantially brittle. These characteristics have been found to facilitate pushing debris out of the shredding mechanism of paper shredders thereby improving the cleaning of the shredding mechanism.

Retaining an even distribution of a measured amount of lubricant, or other agent, across a lubrication sheet has been discovered to render many advantages. For example, retaining an even distribution of a measured amount of lubricant across a lubrication sheet can improve consistent lubrication of shredding mechanisms as well as consistent removal of debris resulting in additional cleaning of the shredding mechanisms.

In addition, retaining an even distribution of a measured amount of lubricant, or other agent, across a lubrication sheet can have safety implications. For example, it has been discovered that uneven distribution of lubrication can result in combustion of lubrication or otherwise dangerous situations. As such, it has become of increased importance for manufacturers to control the amount of lubricant delivered and to ensure consistent and even distribution of lubrication, or other agents. These many benefits, as well as others, are discussed in further detail hereinafter, and can be realized and understood by referring to the drawings and by practicing the various embodiments of the invention.

FIG. 1 illustrates a cellophane enclosure 102 that encases a stack of light corrugated tissue papers 104, or other at least partially corrugated material capable of retaining lubricant, that are encased with a lubricant. Prior to use, the tissue papers 104 can be stored in the cellophane enclosure 102 which holds the tissue papers 104. At the time that one of the tissue papers 104 is to be applied to the shredding mechanism of a paper shredder, the tissue paper is removed from the cellophane enclosure 102 and is fed into the paper shredder. FIG. 1 is an example of a stack of individual substrates that are stored in a protective enclosure 102 prior to use. The protective enclosure 102 may be configured to retain the tissue papers 104 in proximity of a paper shredder. For example, the protective enclosure 102 maybe configured to attach to a paper shredder or be formed integral with a paper shredder.

The individual lubrication sheets can be removed from a carrier and shred. Such embodiments can include a tab for protection of the user from coming into contact with the agents. Individual sheets can carry catchy office jokes, positive thoughts, marketing, or educational instructions which may be reviewed by the end user prior to shredding of the sheet.

FIG. 2 illustrates an exploded view of a sheet 110 having a single substrate 112 that is sealed in an envelope 114 that is formed from a plastic or polymeric material or another oil-impervious material to prevent the lubricant from leaving the substrate prior to shredding. The substrates 104 of FIG. 1 and the substrates 112 of FIG. 2 can be available in various thickness (e.g., $1/16^{th}$ inch, $1/8^{th}$ inch, $1/4^{th}$ inch) and sizes, which can be selected to correspond to the feed and shredding mechanisms of any paper shredder. The substrate can include or consist of paper, Teflon® or another fluoropolymer resin, or another suitable substrate that can carry the lubricant, and be passed through and shredded by the shredding mechanism of the paper shredder. The person performing maintenance places the lubrication sheet 110 into the paper shredder. As the shredder pulls in and shreds the plastic casing 114, the lubricant coats the blades of the shredding mechanism and effectively applies the agent(s) to the shredder without the need to dismantle the device. Moreover, certain substrates, such as fluoropolymer resins and other materials, can also operate as lubricants and partially coat the blades of the shredding mechanism when the lubricant sheet is shredded. Packages of multiple lubrication sheets can be sold to owners of paper shredders, thereby enabling paper shredders to be lubricated immediately whenever the need arises. Such packages can include means for attaching the packages to the shredders or be compatible with an integral sleeve of the shredders such that the sheets are retained within a proximity of the shredder.

Figure 3:
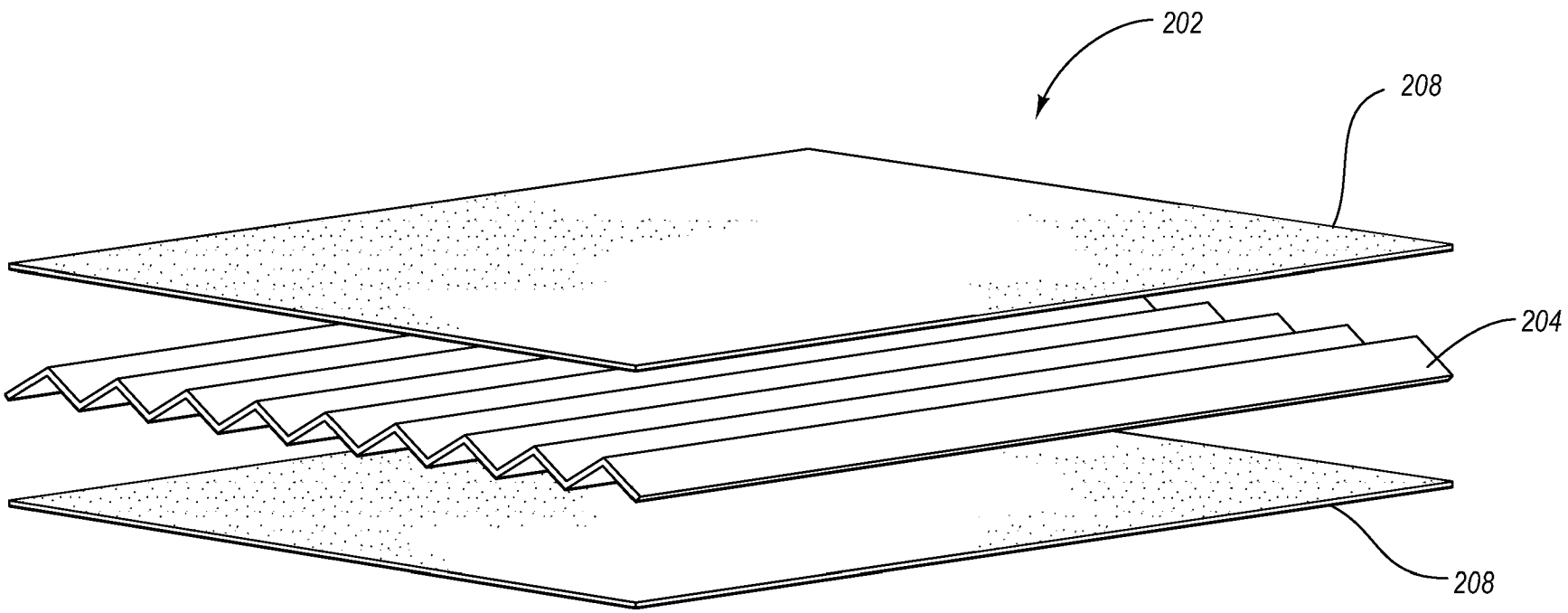
FIGS. 3 and 4 depict a lubrication substrate with an array of small diameter tubes filled with oil for lubricating a paper shredder.
Figure 4:
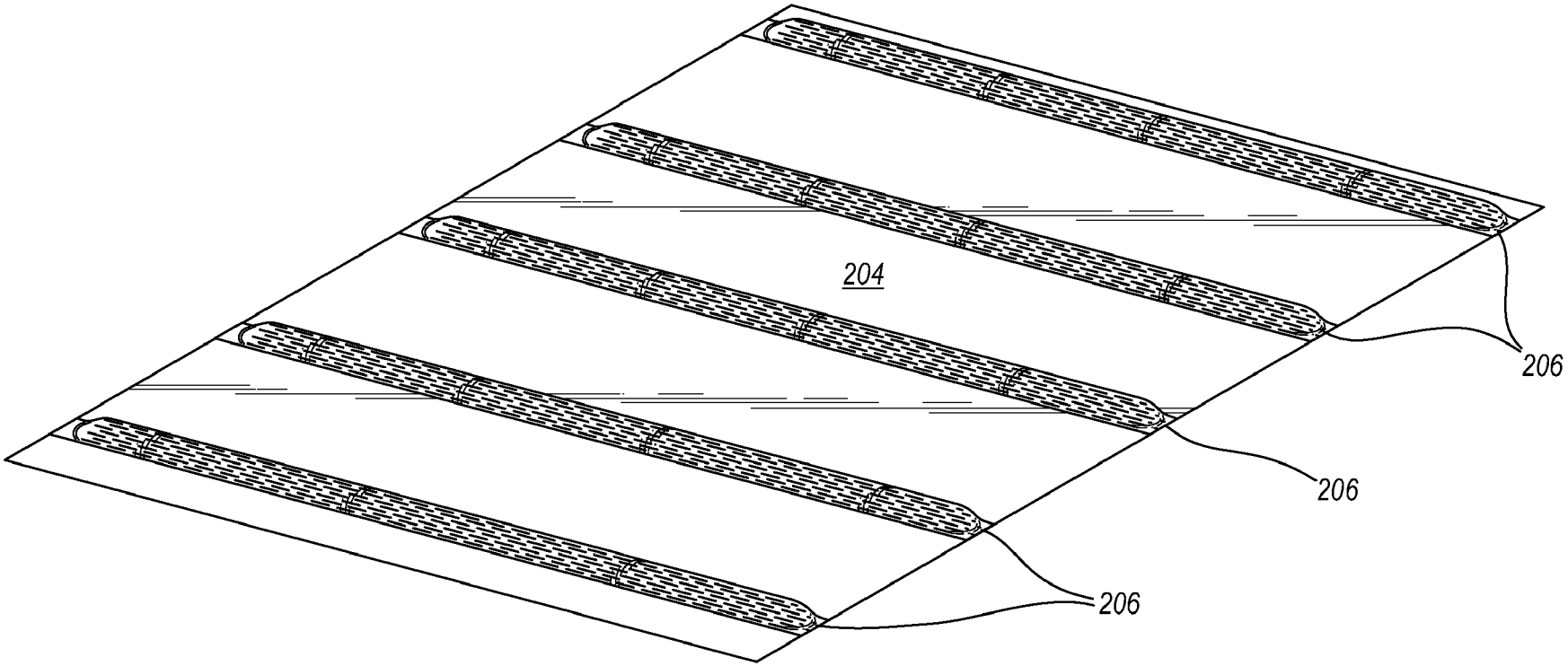

FIGS. 3 and 4 illustrate another embodiment that is similar in many aspects to the lubrication sheets of FIGS. 1 and 2. The lubrication sheet 202 of FIGS. 3 and 4 has a lubrication substrate 204 with an array of small diameter tubes 206 filled with a lubricant or other agent. As shown in the exploded view of FIG. 3, the lubrication substrate 204 can be encased in an envelope 208. The lubrication substrate 204 carries the small diameter tubes 206 rather than being directly impregnated with oil. The tubes 206 can take a variety of forms. For example, the tubes 206 can be integrally formed on, inherent to, or integrated within substrate 204 or can be formed separately and attached thereto during the process of manufacturing the lubrication sheets 202. The tubes 206 can be separate structures or can be formed from a single tubular structure that extends back and forth over the substrate 204 or any combination thereof. The methods for using the lubrication substrates 204 of FIGS. 3 and 4 are essentially the same as those described elsewhere herein. However, the tubes 206 further isolate the lubricant from the user and the environment prior to the substrate 204 being passed through the paper shredder. Corrugation of the lubrication substrate or the casing can also add rigidity and/or stiffness to the lubrication sheet according to any of the embodiments illustrated herein. The tubes 206 can also have different agents in particular tubes for delivery of agents in stages. For example, the tubes 206 can contain a single agent or any combination of lubrication agents, scented agents, and decomposition agents. In one embodiment, tubes each containing different agents may be alternated across a width of a sheet.

Figure 5:
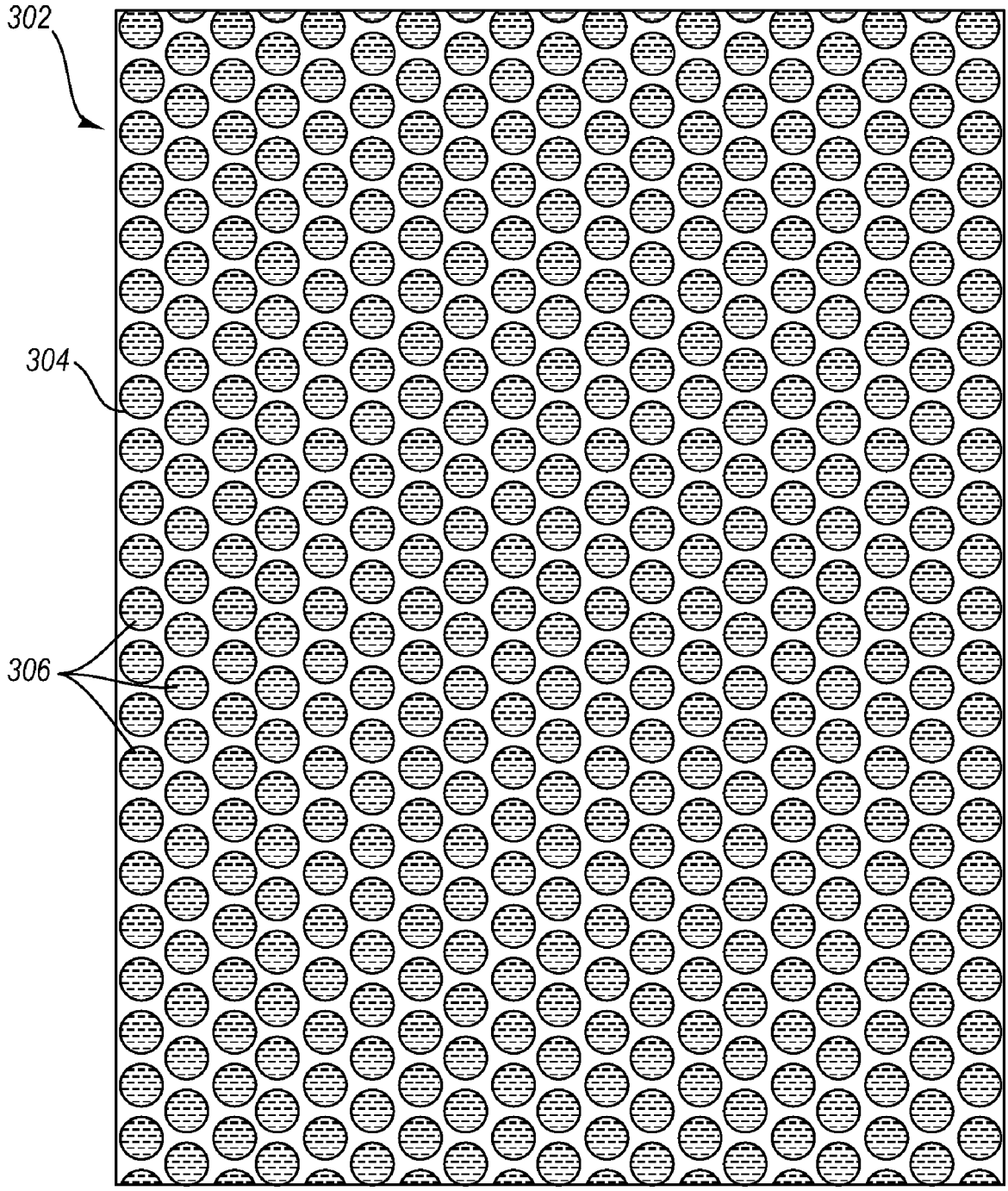
FIGS. 5 and 6 illustrate a lubrication substrate formed from a bubble sheet that contains oil for lubricating a paper shredder.
Figure 6:
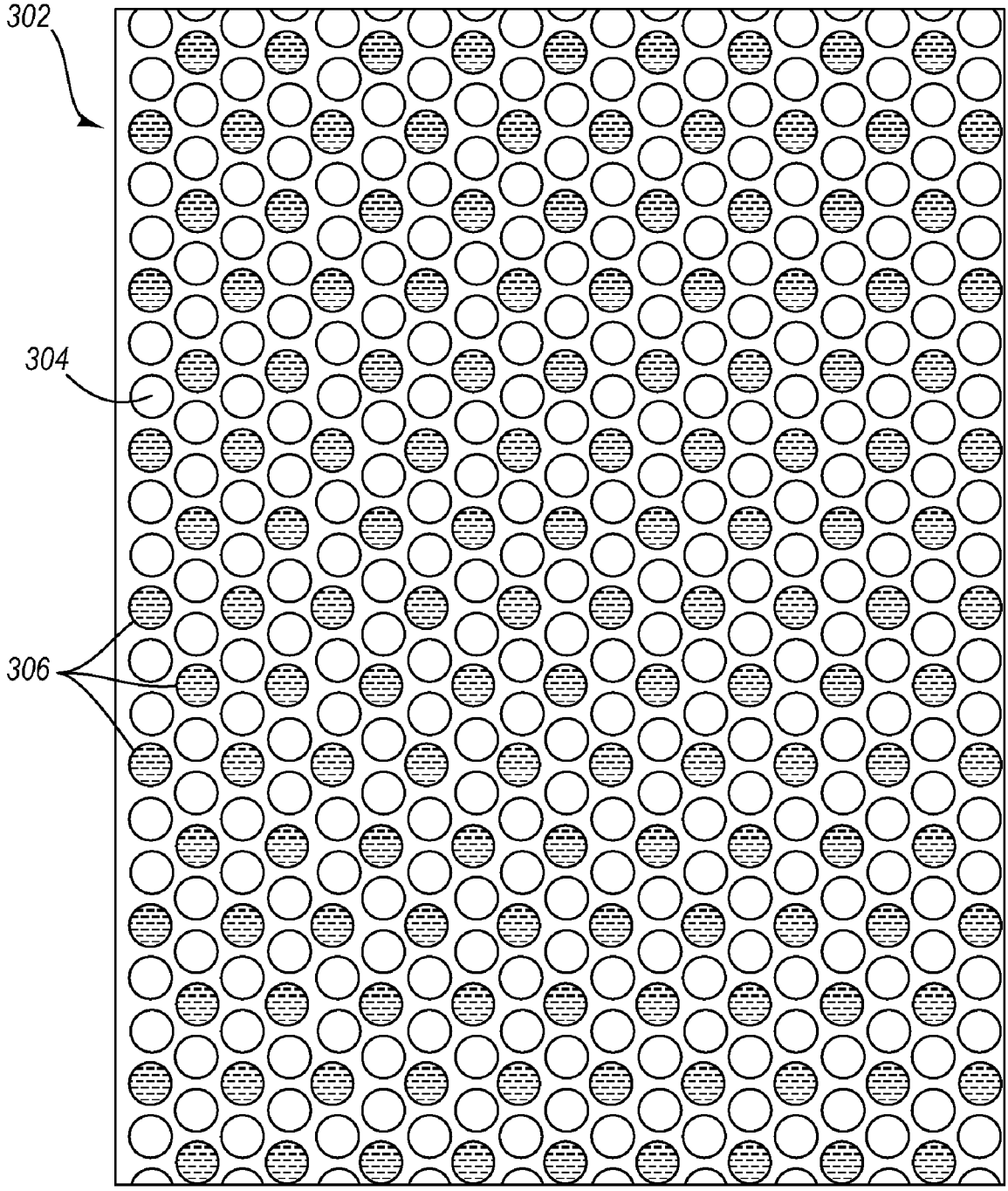

FIGS. 5 and 6 illustrate another embodiment of the lubrication sheets of the invention. This embodiment includes a lubrication substrate 302 in the form of a bubble sheet 304 having a structure similar to conventional bubble wraps that are used for packaging. The bubble sheet 304 can include an at least two dimensional array of bubbles as shown in FIGS. 5 and 6. The bubble sheet 304 is adapted for use in the maintenance and lubrication of paper shredders by filling some, or all, of the individual bubbles 306 with the lubricant and/or any combination of agents or other material. For example, the bubbles 306 can contain lubricant, decomposition agents, cleaning agents, or other agents, and/or scented oil or other scented agent. The bubble sheet 304 effectively encases the agent(s) until the lubrication sheet 302 is passed through the shredding mechanism. The lubrication sheet 302 can include only the bubble sheet 304 and the associated agent, or can instead also include other layers on one or either side of the bubble sheet layer, such as paper, tissue, cellophane, plastic, a fluoropolymer resin, etc., or other material impervious to the agent. It can be appreciated from FIGS. 5 and 6 that the bubbles illustrate one of several examples disclosed herein for retaining an even distribution of a measured amount of lubricant across the lubrication sheet 302. Moreover, any of the teachings of the various embodiments disclosed herein can be implemented together in any combination or permutation, and to any extent. The lubricant usable for the lubrication sheets of the present invention can have various configurations so long as the lubricant will lubricate the cutting structures of the shredder.

In several configurations, a portion of the sheet can be scented or capable of releasing a fragrance before, during, and/or after the lubrication sheet passes through the shredder. To provide the scent or fragrance, the substrate and/or the lubricant can include a scented agent or be otherwise capable of releasing a fragrance. In this manner, the lubrication sheet not only lubricates the shredder's cutting blades, but adds a scent or fragrance to the area surrounding the shredder. The scent or fragrance released by shredding of the sheet can be pleasing to a human and generate a scent reminiscent of the smell of a plant, such as fruit and flowers, or other scents typically employed in conventional air fresheners.

The scented sheets may or may not include other agents than the scented agent. Therefore, the scented sheets may or may not include lubricating and/or decomposition agents. In some embodiments, the shredder may be considered a tool for distributing and releasing aroma via the aromatherapy sheets. However, the delivery of scented oil may also include the benefit of cleaning and/or lubricating the shredder.

Figure 7A:
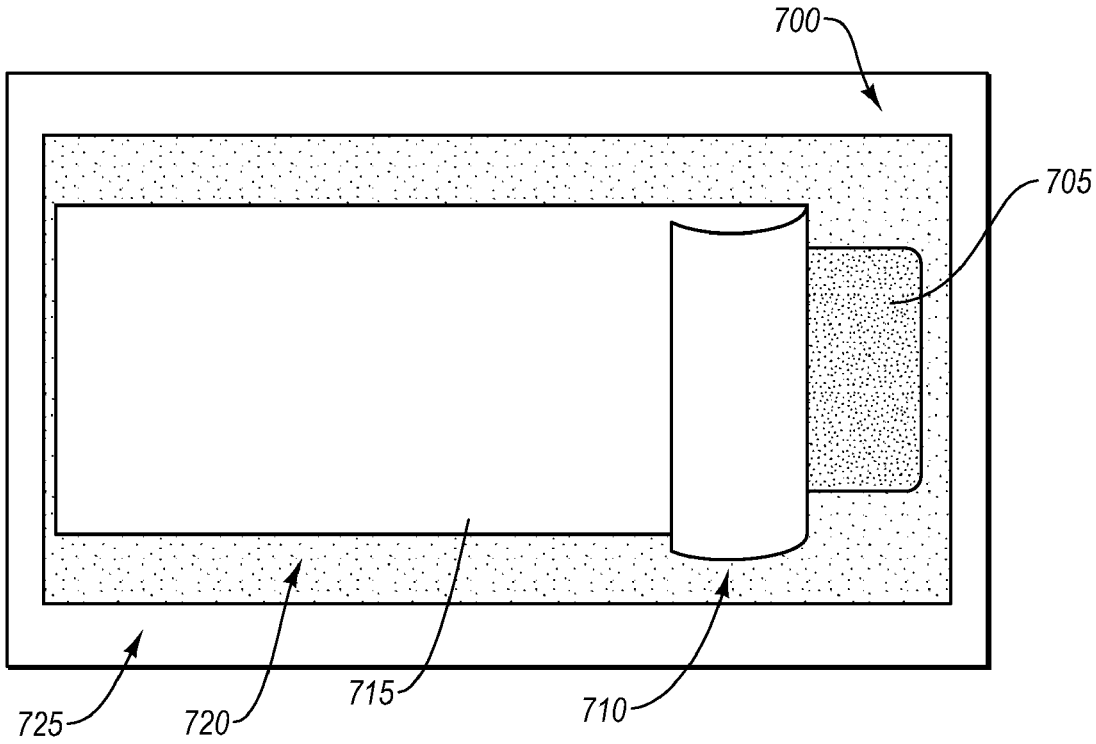
FIGS. 7A and 7B illustrate a sheet for carrying a scented agent.
Figure 7B:
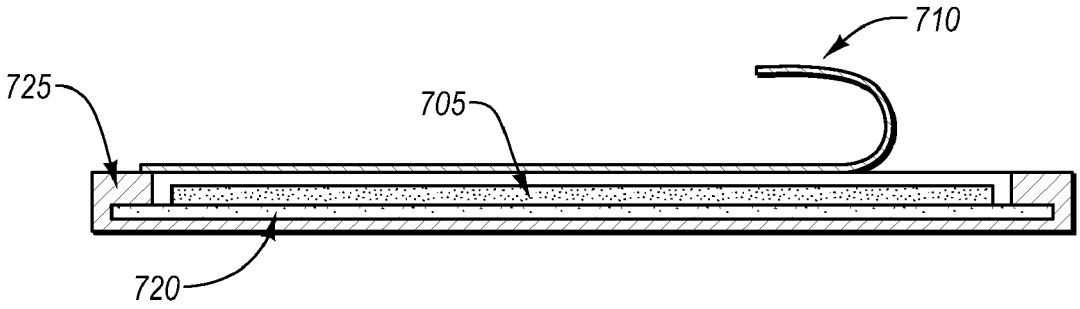

For example, referring to FIGS. 7A and 7B, a sheet 700 carrying a scented agent is illustrated. The scented agent, such as scented oil or other agent capable of dispersing a fragrance, is carried by a substrate 705. The sheet 700 can include a tab 710 for peeling back a shell layer 715 thereby exposing the substrate 705 carrying the scented agent. When release of the fragrance is no longer desired, the tab 710 may be pulled in the opposite direction resealing the shell layer 715 and preventing release of the fragrance by the scented agent. Therefore, once the fragrance is no longer released by the scented agent the sheet 700 can be discarded in any manner.

The substrate 705 may or may not also carry a lubrication agent and/or a decomposition agent; or the scented and lubrication and decomposition agents may constitute the same agent. Referring again to FIG. 7, the sheet 700 can include a second substrate 720 carrying a lubrication and/or decomposition agent. The second substrate 720 can be any of the various embodiments disclosed herein. However, the second substrate 720 may be combined with the substrate 705 carrying the scented agent to apply a lubricant to the shredding mechanism of a paper shredder. The second substrate 720 can be encased within an oil impermeable barrier 725, such as the shell layers discussed above. As such, the sheet can be placed in a room and the tab 710 retracted thereby releasing the fragrance of the scented agent carried by substrate 705. Once the scented agent no longer releases the fragrance, the sheet 700 can be shredded thereby lubricating the shredding mechanism of the paper shredder. The substrates 705 and 720 can be embodied by a single substrate carrying any combination of the various agents discussed herein in any relative amounts for generating a fragrance, lubrication and cleaning of the shredding mechanism, and/or for decomposing paper and ink of shredded documents or debris carried by the shredding mechanism. The scented agent can include designer perfumes or essential oils typically used in aromatherapy.

Figure 8:
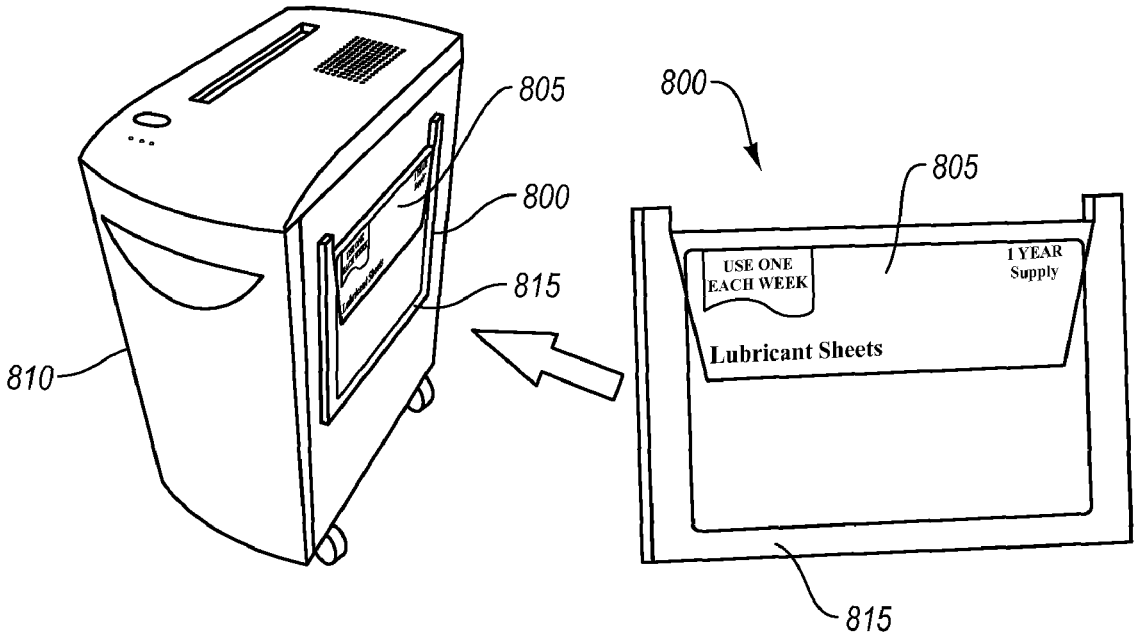
FIGS. 8 and 9 illustrate holders configured to retain one or more lubrication sheets within a proximity of a paper shredder.

According to several embodiments, means for retaining lubrication sheets within proximity of a shredder are disclosed. For example, referring to FIG. 8, a shredder maintenance kit 800 is illustrated according to an example embodiment. The shredder maintenance kit 800 is configured to retain one or more lubrication sheets 805 within a proximity of a paper shredder 810. The shredder maintenance kit 800 illustrated in FIG. 8 includes a sleeve 815 that is configured to receive and removably retain one or more lubrication sheets 805 within an opening of the sleeve 815. The sleeve 815 can include means for attaching the sleeve 815 to the paper shredder 810 in some manner such that the lubrication sleeves 805 are retained in proximity to the paper shredder 810 to which the sleeve 815 is attached. For example, the means for attaching the sleeve 815 can include a mechanical, magnetic, or other means for attaching the sleeve to the shredder. Additional examples include a sticky substance, adhesive, glue, Velcro, magnetic adhesion, screws, bolts, clips, or the like.

Figure 9:
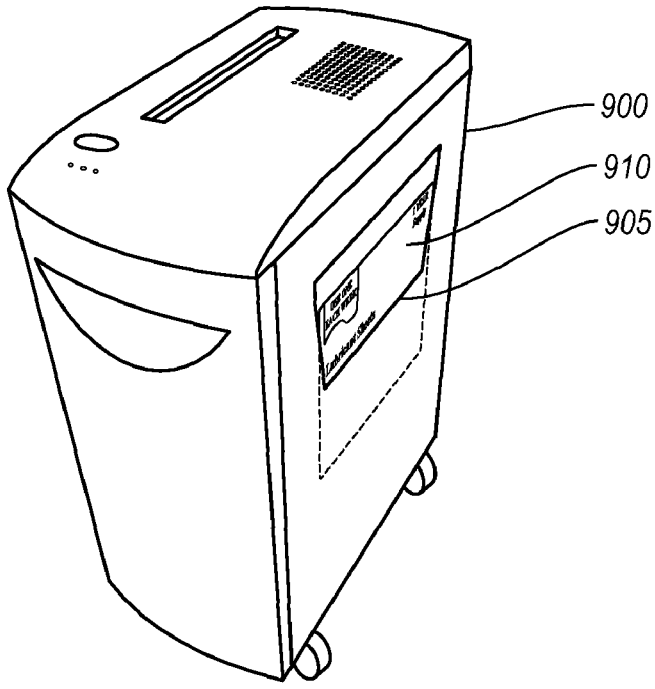

The means for retaining lubrication sheets within proximity of a shredder can also be integrated with a portion of the shredder. For example, referring to FIG. 9, a shredder 900 can include a molded-in sleeve 905 defined by a cavity, groove, or depression for receiving and/or supporting lubricant sheets 910. In this manner the lubricant sheets 910 can be retained within a proximity to the shredder 900. Because the lubrication sheets 910 are retained in a proximity to the shredder 900 the convenience and likelihood that a user will remember to lubricate the shredder 900 using the lubrication sheets 910 is improved.

According to several embodiments, application of agents to the shredding mechanism of paper shredders can be facilitated by a delivery mechanism within the shredder. The application of agents can be autonomous and/or semi-autonomous. According to some embodiments the agents are applied, e.g. sprayed, directly to the shredding mechanism, or applied to paper fed into the paper shredder which is subsequently shredded by the shredding mechanism. According to some embodiments, an agent can be applied to a roller, which subsequently applies the agent to paper fed into the shredder. As such, direct application of agents to the shredding mechanism of paper shredders is performed by mechanism within the shredder as opposed to by the user. As a result, manufactures can design the shredder such that the manner, frequency, and/or amount of agent applied to the shredding mechanism of the paper shredders is controlled by the manufacturer. However, the shredders can also include controls for varying the manner, frequency, and/or amount of agent applied to the shredding mechanism.

Figure 10:
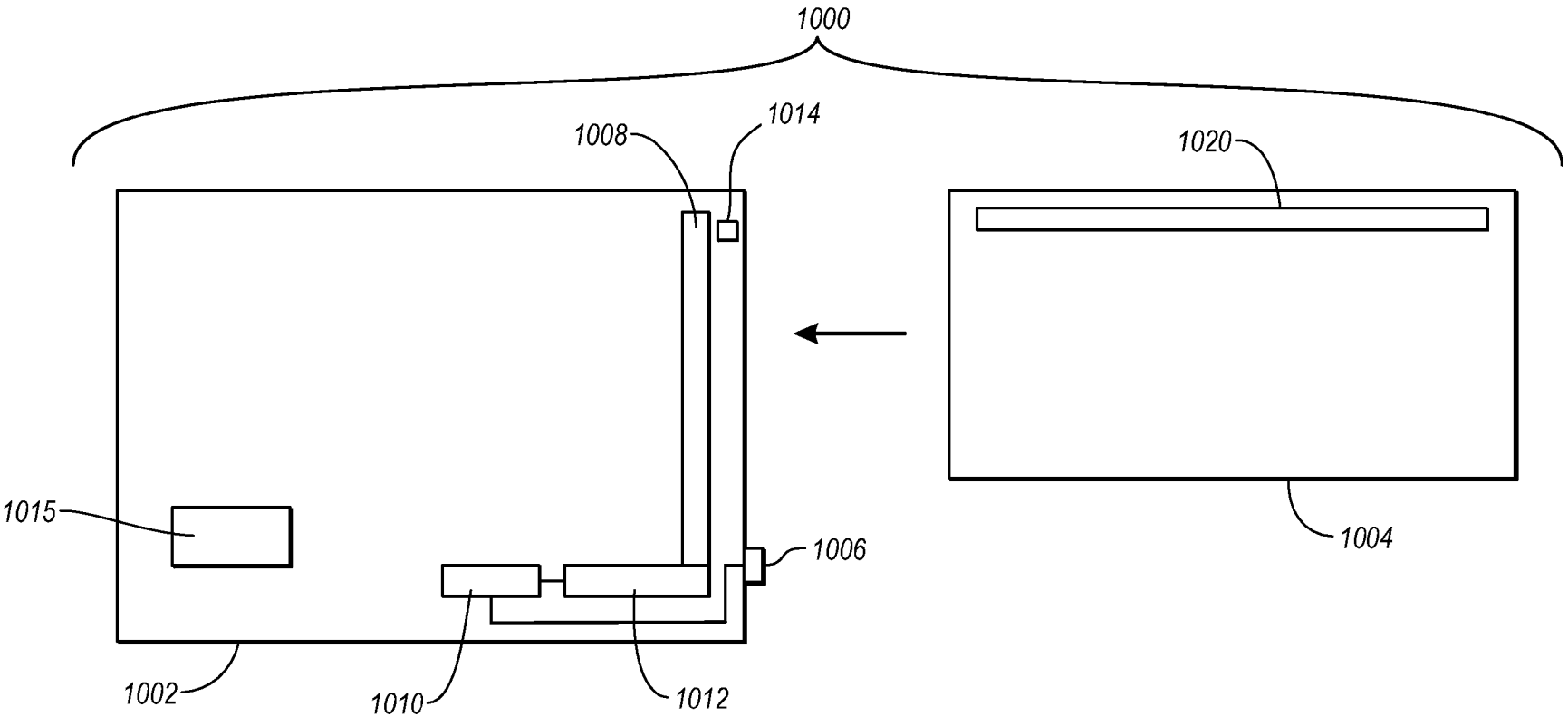
FIG. 10 illustrates a shredder system where a shredder tracks the quantity of material shredded by the shredder.

Turning to FIG. 10, illustrated schematically is a shredder system 1000 according to another configuration of the present invention. The shredder system 1000 has many of the features, characteristics and functions of the lubrication sheets described herein. As such, any description of the lubrication sheets contained herein also applies to the shredder system 1000.

Shredder system 1000 can include a shredder 1002 and a lubrication sheet 1004 usable to lubricate the shredder 1002. It will be understood, however, that the shredder system 1000 can also include just the shredder 1002 without the lubrication sheet 1004. To notify a user when to lubricate the shredder 1002, an indicator 1006 is mounted to the shredder 1002 in such a location to be viewable by the user. As shown in FIG. 10, the indicator 1006 can include a light emitting diode (LED) or a light bulb that is illuminated when it is time to lubricate the cutting structures 1008, such as cutting blades, of the shredder 1002. In another configuration, the indicator 1006 can be included in a liquid crystal display (LCD) of the shredder 1002, i.e., lighting of the LCD and/or displaying text that notifies the user that it is time to lubricate the shredder 1002. The indicator 1006 can include a counter that may display the words "Lubricate Now" when lubrication is determined to be needed. The indicator 1006 may also indicate a scale of use of the shredder. For example, the indicator 1006 may indicate a number of sheets shredded or a number of sheets remaining until lubrication is needed. The scale may be represented by text, numbers, imagery, or other means. The indicator 1006 can be manually or automatically resetable.

To selectively illuminate the indicator 1006, the shredder 1002 can include a mechanism 1010 that tracks the quantity of material passed through the shredder 1002 and/or the time since the last lubrication sheet 1004 passed through the shredder 1002. This mechanism 1010 can include a counter, a timer, or other means for tracking usage of the shredder 1002.

For instance, the mechanism 1010 can be a microcomputer, computer, circuitry, microchip, electromechanical device, combination thereof, or other means that can perform the function of tracking the quantity of material passing through the shredder. The mechanism 1010 can include a sensor for tracking the number of sheets received by the shredder 1002. For example, light sensor, such as an interrupt optical sensor or a reflective optical sensor. As such, the sensor can sense the present and absence of a sheet of paper thereby tracking the number of sheets of paper received. The sensor can also include different wavelengths of light and some wavelengths of light may penetrate the shredded material thereby giving an indication of the thickness and/or density of the shredded material, for example indicating the number of sheets of paper shredded at one time.

When a defined quantity or time has been attained, the indicator 1006 upon the shredder 1002 can be illuminated, for example as a flashing LED, to show that lubrication should occur. When the lubrication sheet 1004 has been received by the shredder 1002, the indicator 1006 can be reset, darkened and/or turned off.

Optionally, the mechanism 1010 can activate a locking mechanism 1012 that prevents the continued usage of the shredder 1002 until the shredder 1002 receives the lubrication sheet 1004. For instance, the locking mechanism 1012 can include a physical locking structure, such as a pin, brake, or other structure to prevent movement of the cutting blades 1008. In another configuration, the locking mechanism 1012 limits current flow to the motor (not shown) that moves the cutting blades. In still another configuration, the locking mechanism 1012 utilizes electromechanical devices, microcomputers, computer, microchips, circuitry, software, combinations thereof, and/or other structures and methods to prevent continued shredding until the shredder 1002 receives the lubrication sheet 1004.

To identify when the shredder 1002 receives the lubrication sheet 1004 and to reset, darken, and/or turn off the indicator 1006, the shredder 1002 can include a sensor 1014. This sensor 1014 can track the material shredded by the shredder 1002 and identify the receipt of the lubrication sheet 1004. To aid with this tracking functionality, the lubrication sheet 1004 includes a notification structure or mechanism 1020 that can be sensed by the sensor 1014. For example, the notification structure or mechanism 1020 can include any type of indicia, structure, signal, and other means for identification of the lubrication sheet 1004. For instance, when the lubrication sheet 1004 includes a means for associating a signal with the lubrication sheet 1004, such as a magnetic strip-type notification structure 1020, the sensor 1014 can detect the strip 1020, for example based on a magnetic signal, and deactivate or reset the indicator 1006 and/or the locking mechanism 1012. Other signal generating means can be implemented such as electromagnetic (such as a radio-frequency identification chip) or electromechanical signal generating means. Similarly, when the lubrication sheet 1004 includes optical indicia, such as a colored strip-type notification structure 1020, the sensor 1014 can detect the strip 1020 and deactivate or reset the indicator 1006 and/or the locking mechanism 1012. Further, when the lubrication sheet 1004 includes a structural indicia, such as a raised notification structure 1020, i.e., a portion of the lubrication sheet that has a surface above the surface of the remainder of the lubrication sheet, the sensor 1014 can detect the raised notification structure 1020 and deactivate or reset the indicator 1006 and/or the locking mechanism 1012.

The lubrication sheet 1004 can also include an electrically charged portion that may be detected by the sensor 1014. For example, the lubricant or other portion of the sheet 1004 can include a slight electrical charge that would be sensed by the sensor 1014 and reset the indicator 1006 and/or locking mechanism 1012. A foil linking or other portion of the sheet 1004 can carry an electrical charge to be sensed by the sensor 1014 and reset the indicator 1006 and/or locking mechanism.

An agent or reaction can also create the electrical charge. An agent can be released when the sheet 1004 is shredded. This agent can react with a component of the sheet 1004 and create an electrical charge that may be detected by the sensor 1014. For example, copper, tin foil, and vinegar when mixed create a modest electrical current when they interact. Any combination of agents can be employed to react when combined (i.e. when the sheet 1004 is shredded) for any purpose, such as to identify the sheet, promote cleaning, promote lubrication, and/or promote safety.

According to some embodiments, the sensor 1014 can be an optical sensor, magnetic sensor, mechanical sensor, electromechanical or electromagnetic sensor, combinations thereof, or other sensor that can identify when the lubrication sheet 1004 is received by the shredder 1002. So long as the sensor 1014 is compatible with the notification structure or mechanism of the lubrication sheet 1004, any type of sensor can be used.

The paper shredder can include a control apparatus. The control apparatus is configured to perform an associated shredding procedure when the sensor identifies the sheet carrying the agent. The associated shredding procedure can include reversing the shredding mechanism for a predetermined time period after the sheet carrying the agent has been shredded. The associated shredding procedure can include reversing the shredding mechanism at various rates. For example, the shredding mechanism can be reversed for about 10 seconds after the sheet carrying the agent has been shredded.

In general, the lubrication sheet 1004 can be any structure that carries a lubricant and can be passed through the shredding mechanism of a paper shredder to deliver the lubricant to the blades of the paper shredder. This technique for lubricating and maintaining paper shredders significantly reduces the cost and effort that has been required in conventional lubrication methods. The invention extends to both the lubrication and other substrates described herein and to the methods of using the substrates as they are passed through the shredding mechanism of a paper shredder.

A paper shredder may also include mechanisms for dispersing fragrance. For example, referring again to FIG. 10, the paper shredder 1002 can include a fan 1015 and a porous and/or mesh container (not shown, e.g. see 1104 in FIG. 11) for receiving shredded material. Thus, after a substrate 1004 carrying a scented agent is shredded by the paper shredder 1002 the fan 1015 can circulate air over the shredded substrate and/or the cutting mechanism thereby enhancing disbursement of the fragrance generated by the scented agent. The fan 1015 can also cool the cutting blades 1008. The fan 1015 can also be associated with the sensor 1014 such that the fan 1015 is turned on upon sensing that the sheet 1004 containing the scented agent is received by the paper shredder 1002. The sheets 1004 may have different signals, structures, or mechanisms to identify the sheet 1004 as a sheet carrying a particular type of agent or combination of agents. For example, the sensor 1014 may identify the sheet 1004 as carrying a scented agent thereby turning on the fan 1015. The sensor 1014 may also identify the sheet 1004 as carrying only a lubrication or decomposition agent, and as a result, not turn on the fan 1015 in this instance.

The shredder 1002 need not be a paper shredder, but may be a shredding device solely for distribution of fragrance. For example, the sheet 1004 can include a scented agent alone where the sheet 1004 is shredded by the shredder 1002 and the fragrance released by the scented agent is distributed by the fan 1015.

Figure 11A:
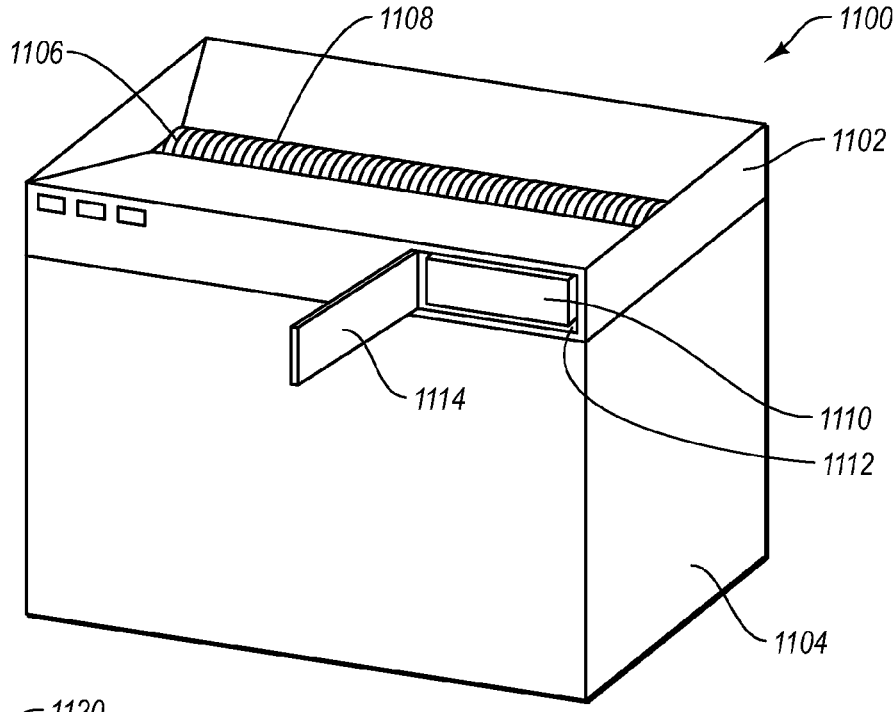
FIGS. 11A, 11B, and 11C illustrate a shredder system having a selectively removable lubricant reservoir.
Figure 11B:
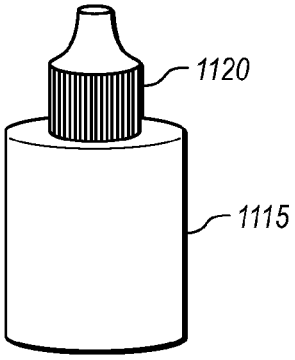
Figure 11C:
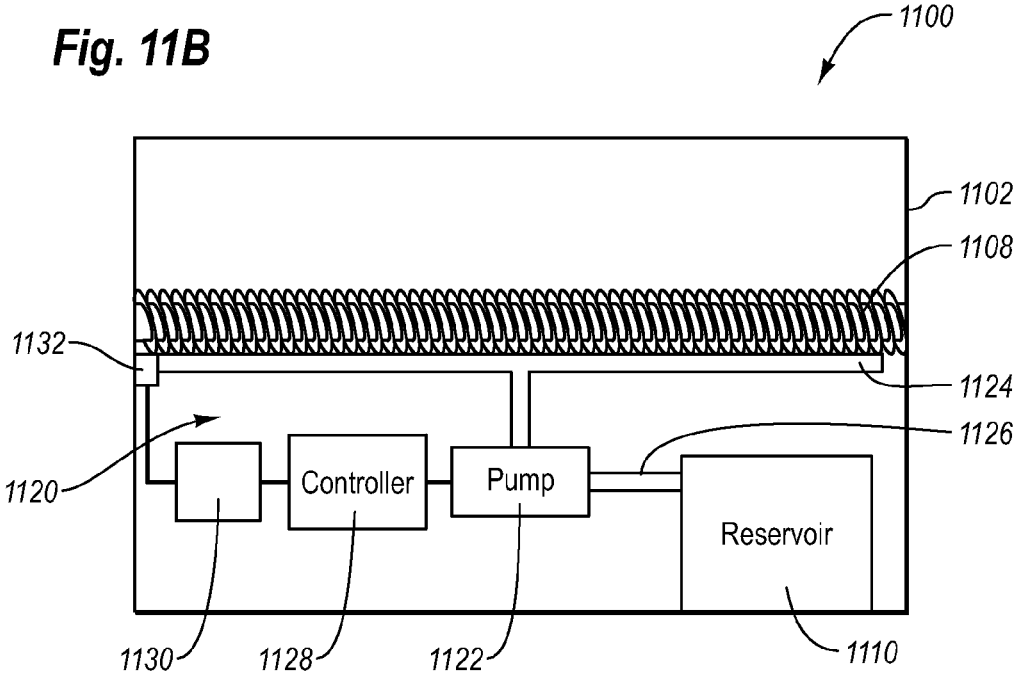

Turning to FIGS. 11A, 11B, and 11C, a shredder system 1100 is illustrated according to the present invention. The shredder system 1100 can include a shredder portion 1102 and a collection portion 1104. The shredder portion 1102 can be optionally and selectively mountable to the collection portion 1104, which functions as the container or receptacle to collect the shredded material. It will be understood, however, that shredder portion 1102 can be integrally formed with the collection portion 1104, with the collection portion 1104 including an access door or mechanism to access the shredded material.

With reference to FIG. 11C, the shredder portion 1102 is configured to shred material inserted into a recess 1106 in the shredder portion 1102. To shred the material, disposed within the recess 1106 are one or more blades 1108. These blades 1108 rotate to cut the material into small pieces and/or strips. Optionally, the shredder portion 1102 can include one or more additional blades (not shown) that move transverse to the direction by which material is inserted into the recess 1106. These one or more additional blades can cut the material into small pieces.

To lubricate the one or more blades 1108, and the optional one or more additional blades (not shown), the shredder system 1100 can include a lubrication reservoir 1110. This reservoir 1110 can be selectively mountable to any portion of the shredder system 1100, such as, but not limited to, the shredder portion 1102 of the shredder system 1100. The reservoir 1110 can be selectively removable and/or disposable. The reservoir 1110 can store lubricant and/or a decomposition agent and may be somewhat akin to a disposable ink jet cartridge used in the printing industry, for example, but is substantially devoid of ink. The reservoir 1110 may or may not be replenishable by an end user. In the exemplary configuration of FIGS. 11A and 11C, the reservoir 1110 is selectively mountable to (and removable from) a bay 1112 formed in the shredder portion 1102. An optional door 1114 can be used to aid with maintaining the reservoir 1110 within the shredder portion 1102. It will be understood, however, that the engagement between the reservoir 1110 and the bay 1112 may be sufficient to maintain the reservoir 1110 within the bay 1112 without the door 1114.

When the reservoir 1110 is mounted to the shredder portion 1102 of the shredder system 1100, the lubricant contained within the reservoir 1110 is in communication (e.g. fluid communication) with a delivery mechanism 1120, as shown in FIG. 13. This delivery mechanism 1120 delivers the lubricant to the one or more blades 1108 so that they become lubricated and function more effectively than if no lubrication were applied. The delivery mechanism 1120 can include one or more of a pump 1122, a distribution member 1124, an inlet conduit 1126, and a controller 1128.

According to some embodiments, the lubrication reservoir can be a conventional bottle of lubricant with a retrofitted cap that fits on the conventional bottle of lubricant. The conventional bottle of lubricant can be received by the bay 1112, which in some embodiments may be oriented vertically so as to receive the bottle of lubricant up-side-down with the retrofitted cap facing into the shredder and coupling to an oil connection such that the oil within the bottle is distributed to the cutting mechanism of the shredder.

For example, referring to FIG. 11B, an example of a removable reservoir 1115 is illustrated. The removable reservoir includes the reservoir 1115 and a cap 1120. The cap can be configured to interface with an inlet conduit (e.g. see 1126 of FIG. 11C) of a shredder system. The cap can also be configured to couple to the reservoir 1115 via threads or the like. The reservoir 1115 can be a conventional or special purpose bottle that is sold containing an agent for application to the shredding mechanism of a paper shredder. Thus, the reservoir 1115 can be purchased by consumers along with, or separate from, the cap 1120 and readily replaced as needed. The paper shredder can also include an indicator indicating when the reservoir 1115 is in need of replacement.

In the example configuration illustrated in FIGS. 11A, and 11C, the pump 1122, such as a hydraulic, electric, or other pump, draws the lubricant from the reservoir 1110 along the inlet conduit 1126, such as a length of tubing or other structure capable of performing the function of enabling a lubricant to travel from the reservoir 1110 to the pump 1122, or other device that causes the lubricant to be delivered to the blades 1108. The inlet conduit 1126, at the end opposite to that mounted to the pump 1122, selectively mounts to the reservoir 1110, either directly or indirectly. It will be understood that, in some configurations, the lubricant can be delivered to the blades 1108 without the use of the pump 1122. For instance, the lubricant can be delivered due to gravity feed, capillary feed, or other technique known to those skilled in the art to deliver a fluid from one location to another. The pump can also be a manual pump, for example a push-button pump, where actuation of the pump is enabled by a user of the shredding device. For example, there can be a series of small orifices and a tube which runs along the length of the blades 1108. When the pump 1122 is operated, e.g. turned on or manually actuated, lubricant is pushed to the blades 1108.

Upon receiving the lubricant, the pump 1122 forces the lubricant into the distribution member 1124, which in turn delivers the lubricant to the blades 1108. The lubricant can flow from a plurality of holes (not shown) adjacent or in close proximity to the blades 1108 to lubricate the blades 1108. The flow rate and operation of the pump 1122 can be controlled by a controller 1128. The distribution member 1124 can have various configurations, such as tubing or other materials that function to enable a lubricant to travel from the pump 1122 to the blades 1108. Further, the distribution member 1124 need not have a plurality of holes, but have a structure that allows the lubricant to wick or be discharged without the need for a hole.

In addition to the above, the controller 1128 can indicate to a user of the shredder system 1100, such as by one or more lights, indicia, or other mechanisms, that there is a low level of lubricant in the reservoir 1110 or that it is time to lubricate the blades 1108. Various types of controllers 1128 are known to those skilled in the art. For instance, and not by way of limitation, the controller 1128 can include one or more microprocessors, micro-controllers, electromechanical devices, or other structures capable of performing the function of controller the delivery of a lubricant to one or more blades.

According to another configuration, the controller 1128 can cooperate with a counter 1130, and associated sensor 1132, such as a motion sensor or sensor that can track or sense rotational motion of the blades 1108. This can be based on a number of rotations of the blades 1108, an amount of paper shredded, or an amount of time that the blades 1108 have rotated. In this manner, the controller 1128 can activate the pump 1122 to deliver lubricant upon the counter 1130 identifying that a predetermined quantity of material has been shredded by the shredder system 1100, for example. For instance, the sensor 1132 can deliver signals indicative of the number of rotations of the blades 1108 to the counter 1130, which in turn delivers a count of the rotations. The controller 1128 can receive the signal and determine whether the desired number of rotations has been attained. When the desired number of rotations has been attained, the controller 1128 can activate the pump 1122 to deliver the lubricant. Alternatively, the counter 1130 can deliver a signal to the controller 1128 that indicates that the desired number of rotations has been attained; again resulting in the controller 1128 activating the pump 1122 to deliver the lubricant.

Various types of counters 1130 are known to those skilled in the art. For instance, and not by way of limitation, the counter 1130 can include one or more microprocessors, micro-controllers, electromechanical devices, or other structures capable of performing the function of the counter. Further, various types of sensors 1132 are known to those skilled in the art. For instance, and not by way of limitation, the sensor 1132 can include one or more optical sensors, magnetic sensors, electronic sensors, or other structures capable of performing the function of identifying the motion of the blades.

The principles of the invention can also be applied to the delivery of other substances into any shredder. For example, the lubrication sheets and lubrication reservoirs disclosed herein can be adapted to carry a substance that facilitates the destruction or decomposition of paper and/or ink (hereinafter "decomposition agent"). The decomposition agent can be carried by the substrates and reservoirs either with or without the lubricant. In addition, the decomposition agent can be carried by substrates, reservoirs, and/or shredding devices having the structures illustrated and otherwise described herein, or that have other structures that will be understood by those of skill in the art upon learning of the inventive concepts disclosed herein.

In one embodiment, the decomposition agent includes microbes that facilitate the decomposition of paper. The microbes can be those that have conventionally been used at toxic waste sites or can be other microbes suitable for enhancing the decomposition of paper.

The decomposition agents and methods for delivering them to paper in a paper shredder as described herein are useful to further prevent unauthorized individuals from gaining access to information written on papers that have been shredded. Thus, the use of the decomposition agents in combination with the physical shredding of paper in a paper shredder can effectively prevent unauthorized individuals from obtaining any useful information from the paper that has been processed by the shredder and the decomposition agent. For example, the decomposition agents may assist in the decomposition of both paper and ink. Moreover, the decomposition agent can be selected so as to decompose ink in particular, or paper in particular. As such, reconstruction and discovery of information recorded on a shredded document can be further inhibited.

The decomposition agents can also be delivered directly to the shredded material and may or may not bypass the shredding mechanism of the paper shredder. For example, as shredded material passes the shredding mechanism it may come into contact with decomposition agent that is fed, for example using a pump or capillary action, to the shredded material. This may enhance destruction of the confidential information carried by the shredded material.

While some shredder embodiments disclosed herein apply the agents directly to the cutting heads of the shredder, in some embodiments, the agents are applied indirectly to the cutting heads by a spray or roller, or by a combination of both direct and indirect application. In some embodiments, the agents can be applied to a material, such as paper, being shredded as the material is fed into the shredder.

Figure 12B:
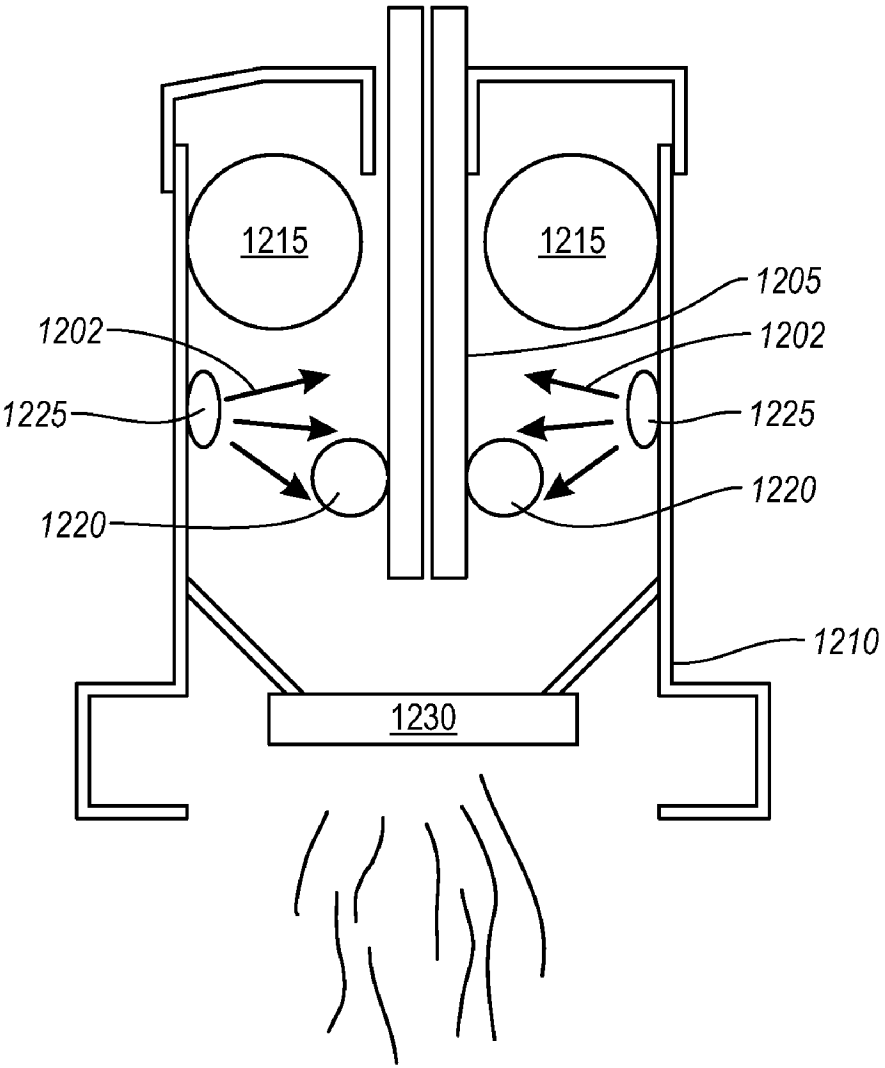
FIGS. 12A and 12B illustrate a paper shredder including a feeding system having one or more means for applying agents to the shredding mechanism of the paper shredder.
Figure 12A:
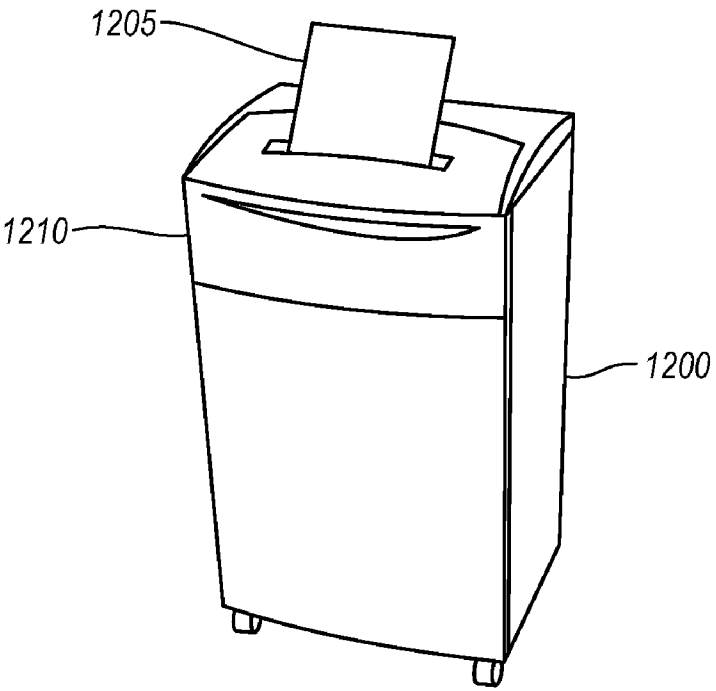

For example, referring to FIGS. 12A and 12B, a shredder 1200 is illustrated where the lubricating, decomposition, cleaning, and/or scented agent 1202 is applied to paper 1205 (or other carrier) as the paper is fed into a top portion 1210 of the shredder 1200. The shredder 1200 can include feed rollers 1215 for receiving and directing the paper 1205 into the shredder 1200. The shredder 1200 can further include agent delivery rollers 1220 for facilitating application of an even distribution of agent 1202 across the paper 1205. The shredder 1200 can further include jets 1225 or other means for delivering the agent 1202 to the paper 1205, agent delivery rollers 1220 and/or directly to a shredding mechanism 1230 of the shredder 1200. Thus, in some embodiments, the agent is applied to the paper 1205 prior to the paper 1205 being shred by the shredding mechanism 1230.

In some embodiments the agents 1202 can be sprayed onto the agent delivery rollers 1220 or otherwise delivered, such as by a pump, to an outer surface of the agent delivery rollers 1220 such that the agent 1202 is applied to the paper 1205 as the paper 1205 is fed into the shredder 1200. In some embodiments, one or more of the feed rollers 1215, agent delivery rollers 1220, and/or the spray jets 1225 can be omitted. For example in some embodiments the feed rollers 1215 alone can distribute the agent 1202 via an agent delivery conduit coupled to the feed rollers 1215.

In such embodiments the rollers delivering the agent 1202 can be perforated, porous, and/or absorptive so that the agent 1202 can be fed to the rollers 1215 or 1220 by a pump and subsequently applied to the paper 1205 as the paper 1205 is fed into the shredder 1200. The agent 1202 may be fed to the rollers 1215 or 1220 from internal to the rollers 1215 or 1220 such that the agent 1202 is allowed to feed outward to the outer surface of the rollers 1215 or 1220. In such embodiments overspray or uneven distribution of agents 1202 can be substantially reduced or prevented. It should be understood that where a plurality of any structure is referred to herein, the embodiments are not limited to such plurality, but include embodiments where only a single structure, such as a single roller, are implemented.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

The invention claimed is:

1. A paper shredder configured for shredding paper documents comprising:

a shredding mechanism with at least one blade capable of shredding paper;

an elongate slot configured to receive one or more sheets of a paper document;

a feeding mechanism in communication with the elongate slot and configured to feed one or more sheets of paper to the shredding mechanism;

a delivery mechanism configured to deliver an agent to a sheet of paper prior to the paper being shredded by the shredding mechanism; and a reservoir in communication with the delivery mechanism, the delivery mechanism selectively drawing the agent from the reservoir for delivering the agent to a sheet of paper prior to being shredded by the shredding mechanism.

2. A paper shredder according to claim 1, the delivery mechanism including:

a roller configured to apply the agent to a sheet of paper prior to the sheet of paper being shredded by the shredding mechanism.

3. A paper shredder according to claim 2, wherein the roller includes pores, holes, and/or perforations for retaining the agent, wherein the roller applies the agent to a sheet of paper via contact between the roller and the sheet of paper prior to the sheet of paper being shredded by the shredding mechanism.

4. A paper shredder according to claim 2, wherein the roller is a feed roller and/or an agent delivery roller separate from a feed roller.

5. A paper shredder according to claim 1, further comprising a nozzle coupled to the delivery mechanism.

6. A paper shredder according to claim 5, wherein the nozzle is aligned with a feed path of the paper shredder to apply the agent to a sheet of paper prior to the sheet of paper being shredded by the shredding mechanism.

7. A paper shredder according to claim 5, wherein the nozzle is aligned with a roller to apply the agent to the roller which applies the agent to a sheet of paper as the sheet of paper is fed past the roller.

8. A paper shredder according to claim 5, wherein the agent includes at least one of a lubrication agent, a decomposition agent, or a scented agent.

9. A paper shredder according to claim 1, wherein the paper shredder further comprises a mechanism that tracks a quantity of paper material passed through the shredder and/or a time since the agent was last delivered to the shredding mechanism of the paper shredding device.

10. A portable document shredder, comprising:

a shredding mechanism with at least one blade;

an elongate slot configured to receive one or more sheets of a paper document;

a flat sheet carrying a scented agent providing a fragrance, wherein the flat sheet carrying the scented agent includes a first substrate carrying the scented agent and a second substrate carrying a lubricant, wherein the first substrate is configured to be exposed to release the fragrance and subsequently the entire sheet is shredded to lubricate the shredding mechanism;

a feeding mechanism in communication with the elongate slot and configured to feed the flat sheet carrying the scented agent to the shredding mechanism; and a fan configured to distribute the fragrance released by the flat sheet carrying the scented agent to an area surrounding a housing of the shredder when the flat sheet carrying the scented agent is shredded.

11. A shredder according to claim 10, further comprising:

a porous or mesh container configured to receive the shredded sheet.

12. A shredder according to claim 10, wherein the fan is located so as to cool the shredding mechanism in addition to distributing the fragrance.

13. A shredder according to claim 10, wherein the fragrance includes the smell of a plant, a flower, or a scented oil.

14. A shredder according to claim 10, wherein the scented agent also lubricates the shredding mechanism of the paper shredder when the flat sheet carrying the scented agent is shredded.

15. A paper shredder comprising:

a shredding mechanism with at least one blade capable of shredding paper;

a feeding mechanism configured to feed paper to the shredding mechanism;

a delivery mechanism comprising a roller configured to apply an agent to the paper prior to the paper being shredded by the shredding mechanism; and a reservoir in communication with the delivery mechanism, the delivery mechanism selectively drawing the agent from the reservoir for delivering the agent to the paper by the roller prior to being shredded by the shredding mechanism.

16. A paper shredder according to claim 15, wherein the roller is a feed roller and/or an agent delivery roller separate from a feed roller and includes pores, holes, and/or perforations for retaining the agent, wherein the roller applies the agent to the paper via contact between the roller and paper prior to the paper being shredded by the shredding mechanism.

17. A paper shredder configured for shredding paper documents, comprising:

a housing;

a shredding mechanism disposed within the housing and having at least one blade capable of shredding paper;

an elongate slot formed in the housing and configured to receive one or more sheets of paper;

a mechanical feeding mechanism comprised of at least one roller in communication with the elongate slot and configured to feed one or more sheets of paper to the shredding mechanism;

a reservoir on or in the housing for holding therein a liquid agent to be delivered to the at least one blade of the shredding mechanism;

a delivery mechanism in fluid communication with the reservoir and configured to receive the liquid agent from the reservoir and directly or indirectly deliver the liquid agent to the at least one blade of the shredding mechanism; and an indicator that indicates a need for lubrication, wherein the indicator comprises an LED, a light bulb, an LCD display, text, numeric information, or imagery and wherein the indicator is mounted to the shredder in such a location to be viewable by the user.

18. A paper shredder according to claim 17, wherein the agent includes at least one of a lubrication agent, a decomposition agent, or a scented agent.

19. A paper shredder according to claim 17, wherein the reservoir is selectively removable from the housing.

20. A paper shredder according to claim 19, further comprising an inlet conduit in communication with the delivery mechanism and a threaded cap that is releasably attached to the inlet conduit and to which the reservoir is removably attached.

21. A paper shredder according to claim 17, wherein the delivery mechanism is configured to deliver the liquid agent to the at least one blade by at least one of a nozzle, a spray, a roller, a sheet of paper, gravity feed, or capillary feed.

22. A paper shredder according to claim 17, further comprising a sensor configured to track a quantity of sheets passed through the shredder.

23. A paper shredder according to claim 17, further comprising a mechanism that tracks a quantity of material passed through the shredder and/or a time since the liquid agent was last delivered to the shredding mechanism of the paper shredding device.

* * * * *